US009938116B2

(12) United States Patent
Christen

(10) Patent No.: US 9,938,116 B2
(45) Date of Patent: Apr. 10, 2018

(54) SELF-CENTERING ELEVATOR CAGE DOOR SUSPENSION

(71) Applicant: Inventio AG, Hergiswil (CH)

(72) Inventor: Jules Christen, Altdorf (CH)

(73) Assignee: INVENTIO AG, Hergiswil (CH)

( * ) Notice: Subject to any disclaimer, the term of this patent is extended or adjusted under 35 U.S.C. 154(b) by 185 days.

(21) Appl. No.: 14/445,107

(22) Filed: Jul. 29, 2014

(65) Prior Publication Data

US 2014/0332323 A1 Nov. 13, 2014

Related U.S. Application Data

(63) Continuation of application No. 13/218,886, filed on Aug. 26, 2011, now abandoned.

(30) Foreign Application Priority Data

Aug. 27, 2010 (EP) ..... 10174263

(51) Int. Cl.

| | |
|---|---|
| ***B66B 13/12*** | (2006.01) |
| ***B66B 13/08*** | (2006.01) |
| ***B66B 13/30*** | (2006.01) |
| ***E05D 15/10*** | (2006.01) |

(52) U.S. Cl.

CPC ..... *B66B 13/12* (2013.01); *B66B 13/08* (2013.01); *B66B 13/30* (2013.01); *E05D 15/1005* (2013.01)

(58) Field of Classification Search

CPC ..... B66B 13/06; B66B 13/08; B66B 13/10; B66B 13/12; B66B 13/30; E05D 15/0604; E05D 15/0608; E05D 15/0652; E05D 15/0686; E05D 15/1005; E05D 15/1021; Y10T 16/31; Y10T 16/3834

See application file for complete search history.

(56) References Cited

U.S. PATENT DOCUMENTS

| | | | | |
|---|---|---|---|---|
| 401,273 A | | 4/1889 | Hester | |
| 425,477 A | * | 4/1890 | Weaver | E05D 15/0634 16/105 |
| 832,457 A | | 10/1906 | Cossey | |
| 1,169,755 A | | 2/1916 | Abbott | |
| 1,866,392 A | | 7/1932 | Brady | |
| 2,053,799 A | | 9/1936 | Mason | |

(Continued)

FOREIGN PATENT DOCUMENTS

| | | |
|---|---|---|
| CN | 1331655 A | 1/2002 |
| EP | 2019074 A1 | 1/2009 |

(Continued)

*Primary Examiner* — Minh Truong

(74) *Attorney, Agent, or Firm* — William J. Clemens; Shumaker, Loop & Kendrick, LLP

(57) ABSTRACT

An elevator installation includes an elevator cage, which is movable in an elevator shaft, with a cage door suspension for a cage door, wherein the cage door suspension is movably arranged at the elevator cage by means of at least one movable mount. During operation of the elevator installation, a self-centering aligning movement of the cage door suspension from a skewed setting of the elevator cage, in correspondence with a skew setting axis, to an approximately vertical and centered setting of the cage door suspension in correspondence with a vertical, can be performed.

10 Claims, 5 Drawing Sheets

(56) References Cited

U.S. PATENT DOCUMENTS 2,056,174 A 10/1936 Earhuff et al.
2,807,836 A * 10/1957 Knowles ..... E05D 15/1021 49/212
2,878,532 A 3/1959 Clark
2,893,071 A * 7/1959 Oden ..... E05D 15/1065 16/96 R
3,412,507 A * 11/1968 Sterner ..... E05D 15/1021 49/212
3,431,678 A 3/1969 Stuart, Jr. et al.
4,149,615 A 7/1979 Kappenhagen
4,177,881 A * 12/1979 Kappenhagen ..... B66B 13/08 187/324
4,483,045 A 11/1984 Shelton et al.
4,651,469 A * 3/1987 Ngian ..... E05D 15/1021 16/87 R
4,698,876 A 10/1987 Karita
4,753,038 A * 6/1988 Sohlstrom ..... E05D 15/1065 49/212
4,876,765 A 10/1989 Karita
5,301,468 A 4/1994 Kamezaki
5,566,505 A 10/1996 Kamezaki
5,655,626 A * 8/1997 Spiess ..... B66B 13/30 160/196.1
5,878,846 A 3/1999 O'Donnell
6,416,144 B1 7/2002 Houston et al.
6,446,759 B1 * 9/2002 Kulak ..... B66B 13/12 187/319
6,745,813 B2 6/2004 Yorgason
7,100,745 B2 9/2006 Bisang et al.
7,117,559 B1 * 10/2006 Barber ..... E05D 15/063 16/105
2012/0048657 A1 * 3/2012 Christen ..... B66B 13/08 187/330
2015/0047150 A1 * 2/2015 Saito ..... E05F 5/02 16/103

FOREIGN PATENT DOCUMENTS

JP 54175141 U 12/1979
JP 5178570 A 7/1993
JP 11-11841 A 1/1999
JP 2005187090 A 7/2005

* cited by examiner

SELF-CENTERING ELEVATOR CAGE DOOR SUSPENSION

CROSS-REFERENCE TO RELATED APPLICATIONS

This application claims priority to European Patent Application No. 10174263.3, filed Aug. 27, 2010, which is incorporated herein by reference. This application is a continuation of the co-pending U.S. patent application Ser. No. 13/218,886 filed Aug. 26, 2011.

FIELD

The present disclosure relates to a suspension and a drive of an elevator cage door.

BACKGROUND

Elevator cages often have cage doors in the form of a double sliding door, the door elements of which are displaceably arranged in a so-termed door lintel or door cross-beam, usually by means of rollers on rails. This transom is often fixedly arranged at the elevator installation and accommodates a drive for opening and closing the cage door.

Safety specifications for operation of an elevator installation often require that in normal operation an actuation of the cage door is possible only in the case of a position of the elevator cage in which the cage door corresponds with a shaft door. Entrainer rollers are for this purpose usually arranged at the shaft doors or in a shaft-door door transom and so act on a mechanical unlocking means or on entrainer yokes at the elevator cage so that actuation of the cage door is released only in the corresponding region.

Similarly, for safety reasons opening of a shaft door is usually provided in normal operation only when an elevator cage correspondingly stands in front thereof. This is similarly carried out by way of the described entrainer yokes and entrainer rollers in that usually the cage door drive drives the cage door elements with the entrainer yokes fastened thereto, the entrainer yokes again drive or entrain the entrainer rollers at the shaft and these in turn open or close shaft door elements. In principle, the entrainer rollers at the shaft can be arranged directly on the shaft door elements or in a shaft door lintel.

However, due to one-sided loading of the elevator cage a skewed setting thereof can occur, which within the predetermined tolerances or within the play in the guides at the guide rails is accompanied by an alignment error of the elevator cage transom. This alignment error of the elevator cage transom in turn can mean that an asymmetrical release of the entrainer yokes, or even no actuation of the mechanical unlocking means and release switch possibly connected therewith, of the cage door opening takes place at the arrangement, which is usually in pairs or in quadruples, of shaft door entrainer rollers. The cage door and shaft door actuation thus does not function reliably or cage door blocking fault alarms are triggered.

The cause of these disturbances is often an alignment error, which possibly arises due to unbalanced loading of the elevator cage, of the elevator cage with respect to the shaft door or the absence of positional correspondence between elevator cage and shaft door.

The published specification JP-A-11011841 discloses a door lintel for a story door which is fastened to the shaft wall by means of slots and a hanging housing so that, in the case of fire shaft, door elements which expand due to the action of heat do not jump out of the guides. Because it can be technically difficult to realize in another manner, and because the shaft door elements are higher than wide, the disclosed arrangement is confined to vertically arranged slots. Apart from the fact that merely a door lintel of a shaft door and not a cage door is described, there is no compensating movement of the shaft-door door lintel in anything other than vertical direction. Thus, the proposal of a solution for the above-described problem of the absence of positional correspondence between the elevator cage and the shaft door is also not suggested.

A further published specification JP-A-05178570 discloses a mounting, which is pivotable within limits and thus positionally precise, of a shaft-door door lintel by means of several screws with an eccentric shank. However, once in the state of being mounted, no further compensating movement is provided.

SUMMARY

In some embodiments, a cage door transom, independently of any faulty settings of the elevator cage during operation, allows for a self-centering compensating or aligning movement. For this purpose the cage door transom in the mounted operational state is movably mounted on the elevator cage.

According to a first variant of embodiment of a self-centering movable arrangement the cage door transom is rotatably mounted at a central point by means of a rotary bearing. The central rotary bearing can in this regard be designed to be so free-moving that a self-actuated alignment movement of the cage door transom takes place solely due to gravitational force. The aligning movement can in this connection be assisted in that the cage door transom has two identical weight fulcra at the distal ends thereof, which are as far away as possible from the centrally arranged central rotary bearing. This can be managed by appropriate shaping of the cage door transom or its frame, by appropriate positioning of the cage door drive or, however, also by the arrangement of weights.

In order to avoid possible rise in resonance of the freely rotatable cage door transom, identical movement-retarding springs or shock dampers can be provided at both ends.

A variant of embodiment of a cage door transom with a central rotary bearing comprises a rotary bearing which is not so free-moving that gravitational force suffices for the aligning movement. Instead thereof it is effected by the entrainer rollers at the shaft door or at the shaft-door door lintel during travel past of the elevator cage. The rotary bearing can for that purpose have an increased frictional resistance or be designed as a rotary bearing resilient in torsion.

The rotary bearing can be a ball bearing, roller bearing or needle-roller bearing which allows aligning movement in a plane. However, it can also be a ball joint which can effect aligning movement with respect to any skewed setting of the elevator cage.

A further variant of embodiment of a cage door transom, which is arranged in a central rotary bearing, whether the free-moving, increased-friction or torsionally resilient constructional variant, comprises additional curved guides at the distal ends of the cage door transom. These assist the rotational aligning movement of the cage door transom and reduce loading of the central rotary bearing.

A further variant of embodiment of a movably arranged cage door transom comprises at least one flexible bearing, for example in the form of a resilient coupling element. In this manner, aligning movements of the cage door transom can take place in any direction within a defined flexible range in that the entrainer rollers exert on the shaft door or on a shaft door lintel, when the elevator cage passes, the necessary pressure for aligning or centering the cage door transom.

A further variant of embodiment of a movably arranged cage door transom is characterized in that at least two rotatably mounted mounting levers mount the cage door transom in the manner of a swing. In this manner a self-centering aligning movement can take place at least in one direction.

In a further variant of embodiment of a movably mounted cage door transom, guides are provided along which the cage door transom is freely displaceable by means of, for example, rollers. In addition, it is also possible to arrange springs at, for example, the distal ends of the cage door transom so that the aligning movement is sprung or always returns to a starting point.

By means of the described movable mounting variants an out-of-position cage door transom self-centers from the skewed setting to a centrally aligned and approximately vertical position which ensures faultless functioning of the cage door actuation and the shaft door actuation coupled therewith. The aligning force or the aligning pulse, which is decisive for the aligning movement of the cage door transom, derives from the entrainer rollers at the shaft door.

However, it is also possible to allow exertion of the aligning force or aligning pulse from a correction rail at the shaft, which acts on one or more aligning rollers at the cage door transom. This correction rail can be fastened directly to the shaft wall independently of the shaft door and be respectively mounted in lengths in the region of a shaft door or, however, also to extend over the entire conveying height of the elevator cage. The latter variant of embodiment has the advantage that the aligning movement does not take place at every passing of a shaft door and travel comfort does not suffer.

The cage doors can, however, remain in the skewed setting of the elevator cage in the described cage-door transom arrangements. Consequently, a further variant of embodiment provides a movable self-centering cage-door transom arrangement such that the cage door or the cage door elements co-describe the aligning movement. For this purpose, the cage door elements are obviously displaceable together with the cage door transom in longitudinal direction, but connected relatively free of play and movable with respect to the frame of the elevator cage. This can have the advantage that, independent of a possible skewed setting of the elevator cage, not only the cage door transom, but also the cage door elements, are aligned parallel with respect to the always vertically upright shaft doors. The cage door elements can in this regard be arranged to hang at the cage door transom or, however, be movably fastened with respect to the frame of the elevator cage within a door frame fixed relative to the cage door transom.

The described variants of embodiment of a cage door transom are capable of combination with one another to the extent that, for example, the design variant with a central bearing can be additionally equipped with flexible bearings and/or with springs so that the rotation takes place only in a limited or sprung range. The same also applies to the swing-shaped variant of embodiment with at least two rotatably mounted mounting levers. Moreover, all variants of embodiment of a cage door transom, including the last-described combinations, can be combined as desired with the coupling, which was described in the foregoing paragraph, of the cage door elements with the aligning movement of the cage door transom. Moreover, all variants of embodiment of a movable cage door transom are operable in such a manner that gravitational force and/or the entrainer rollers at the shaft door and/or the correction rail—in lengths or continuous—exerts or exert the aligning force or the aligning pulse for the aligning movement of the cage door transom.

At least some embodiments of a cage door suspension or an elevator installation equipped with a cage door suspension can bring the following advantages by comparison with a conventional cage door suspension or by comparison with an elevator installation with a conventional cage door suspension:

- Skewed settings of the elevator cage which arise due to loading situations thereof at one side no longer have the consequence of dislocation of the cage door transom.
- Disturbance situations and fault alarms thereby arising are largely excluded.
- Mechanical loads and wear reduce.
- The need and the costs with respect to precision of the guide rails and guide shoes of the elevator cage reduce.
- Elevator installations equipped in accordance with at least some of the disclosed embodiments gain mechanical comfort as well as transport comfort by shortened conveying time, so-termed 'fly time'.

BRIEF DESCRIPTION OF THE DRAWINGS

The disclosed technologies are explained in more detail symbolically and by way of example on the basis of the figures. The figures are described conjunctively and in general. The same reference numerals signify the same components and reference numerals with different indices indicate functionally equivalent or similar components.

In the drawings.

DETAILED DESCRIPTION

Figure 1:
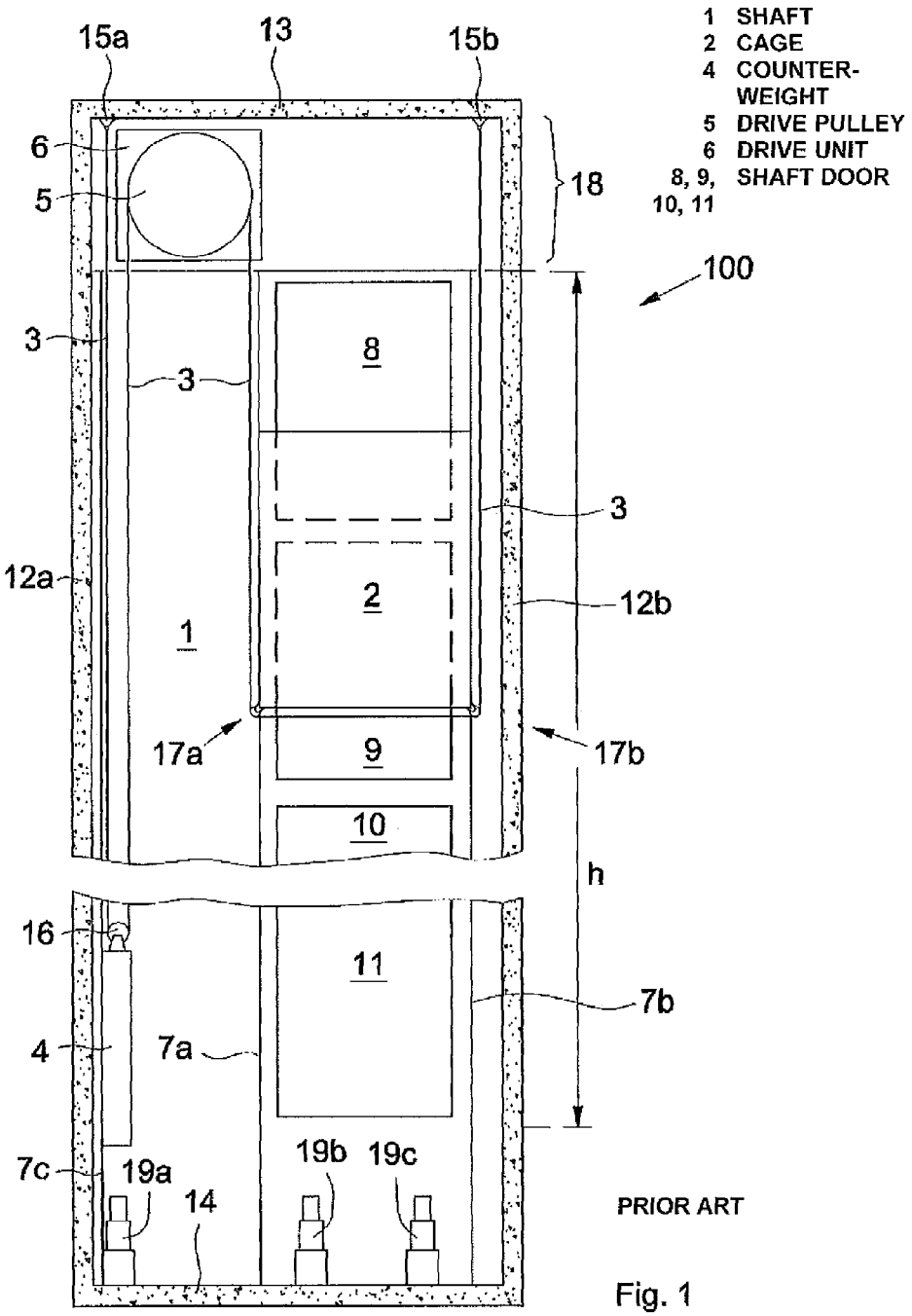
FIG. 1 shows a schematic illustration of an elevator installation according to the prior art.

FIG. 1 shows, by way of example, a conventional elevator installation 100 with an elevator cage 2 which is movable in an elevator shaft 1 and which is connected with a counterweight 4 by way of supporting and driving means 3. The supporting and driving means 3 is in operation driven by a drive pulley 5 of a drive unit 6. The exemplifying construction shows a drive-pulley elevator, but other elevator types with a cage door suspension can be used with at least some embodiments of the disclosed technologies. The elevator cage 2 and counterweight 4 are guided by means of guide rails 7*a* and 7*b*, which extend over the shaft height, for the elevator cage 2 and a (visible) guide rail 7*c* for the counterweight 4. The elevator installation 100 has an uppermost story with an uppermost shaft door 8, a second-uppermost story with a second-uppermost shaft door 9, further stories with a further shaft door 10 and a lowermost story with a lowermost shaft door 11.

The elevator shaft 1 is formed by shaft side walls 12*a* and 12*b*, a shaft ceiling 13 and a shaft base 14. The supporting and driving means 3 is fastened at a first support means fixing point 15*a* to the shaft ceiling 13 and guided by a deflecting roller 16 of the counterweight 4 and over the drive pulley 5 of the drive unit 6. From there in turn the supporting and driving means 3 is guided, for example looping under the elevator cage 2, by two support pulleys 17*a* and 17*b* of the elevator cage 2 and in turn to a second support means fixing point 15*b* at the shaft ceiling 13. A conveying height h for the elevator cage 2 thus results.

The drive unit 6 is arranged in a shaft head or engine room 18. A buffer 19*a* for the counterweight 4 is arranged on the shaft base 14, as well as two buffers 19*b* and 19*c* for the elevator cage 2.

Figure 2:
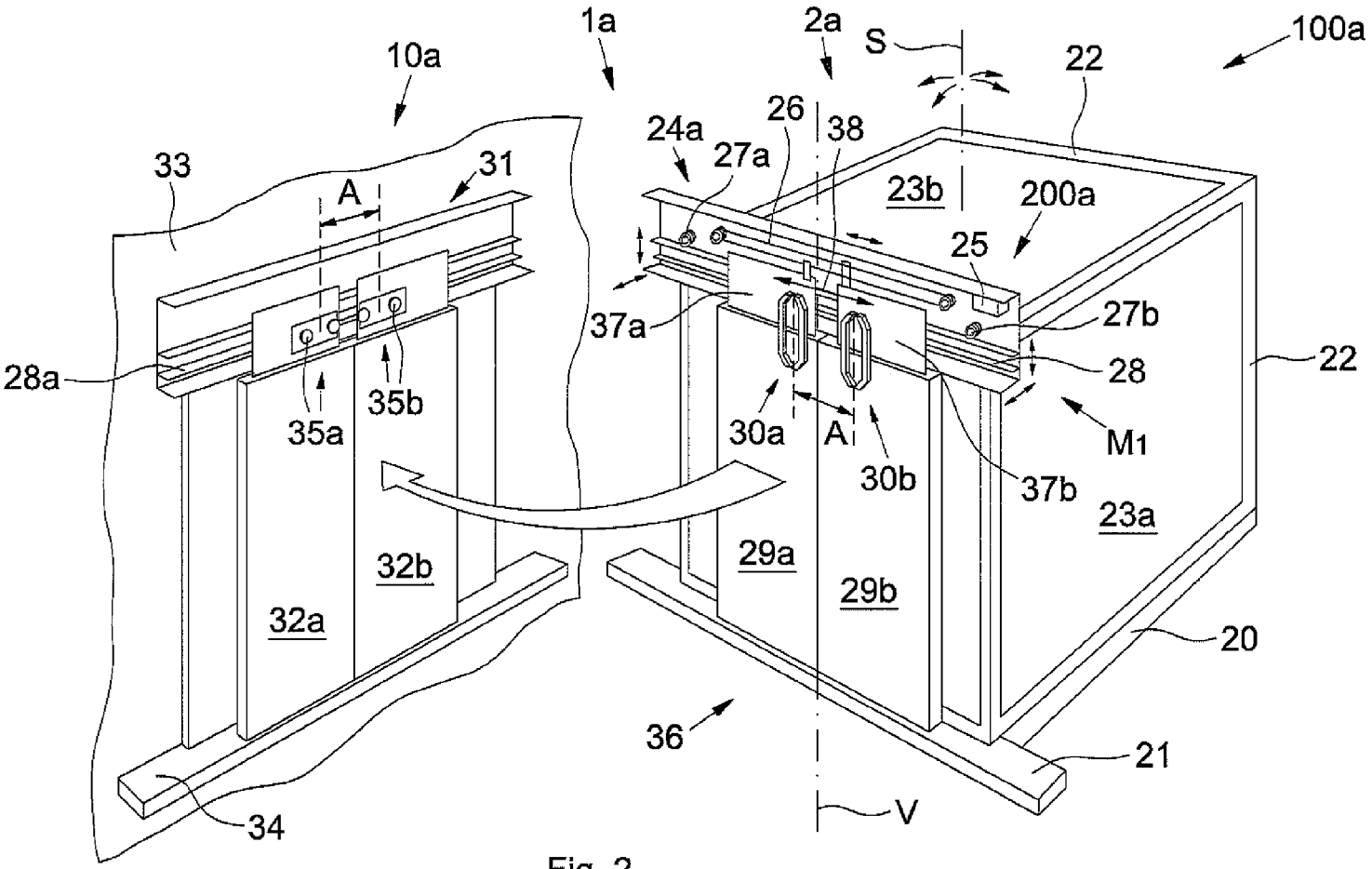
FIG. 2 shows a schematic illustration of a cage door suspension with two flexible bearings in an elevator installation according to FIG. 1.

An elevator installation 100*a* is indicated in FIG. 2, which basically corresponds with a prior art elevator installation shown in FIG. 1. However, the elevator installation 100*a* comprises an elevator cage 2*a* which is formed substantially from a support frame 20, a cage door threshold 21 arranged thereat, a cage frame 22 and cladding surfaces 23*a* and 23*b*. Moreover, a cage door suspension or a cage door transom 24*a* is arranged at the cage frame 22 and, in particular, in the form of a movable mounting 200*a* by means of two flexible bearings 27*a* and 27*b* or two movable couplings. As indicated by double arrows, an aligning movement Mi of the cage door transom 24*a* in all three directions is thereby possible.

The cage door transom 24*a* comprises a motor 25, a belt drive or chain drive 26 and a guide rail arrangement 28 as well as two entrainer plates 37*a* and 37*b*, which are movable relatively free of play in the direction of an opening and closing direction 38 by means of guide rollers (not illustrated in more detail) at the guide rail arrangement 28. Respective cage door elements 29*a* and 29*b* which together form a cage door 36 are arranged at these entrainer plates 37*a* and 37*b*. Respective entrainer yokes 30*a* and 30*b*, which are possibly approximately C-shaped and are formed as a mirror-image pair, are arranged at the entrainer plates 37*a* and 37*b*.

The large curved arrow in outline illustrates that the cage door 36 in an elevator shaft 1*a* of the elevator installation 100*a* and a shaft door 10*a* are opposite one another. This shaft door 10*a* is arranged in masonry 33 or a side wall of the elevator shaft 1*a* and comprises a shaft door transom 31 with a guide rail arrangement 28*a* for shaft door elements 32*a* and 32*b* guided to run therein. The shaft door elements 32*a* and 32*b* are usually also guided within a guide channel (not illustrated in more detail) in a door threshold 34 of the shaft door 10*a*.

Arranged at each of the shaft door elements 32*a* and 32*b* are entrainer roller pairs 35*a* and 35*b*, respectively, in which during operation of the elevator installation 100*a* the entrainer yokes or the entrainer yoke pairs 30*a* and 30*b* engage. In this manner the opening or closing force of the motor 25 is transmitted to the entrainer roller pair 35*a* and 35*b* and the shaft door elements 32*a* and 32*b* open or close together with the cage door elements 29*a* and 29*b*.

If the elevator cage 2*a*, due to a one-sided loading within the cage guide rails, which are not illustrated in more detail in this FIG. 2, should be skewed, the entrainer roller pairs 35*a* and 35*b* exert on the then similarly skewed entrainer yokes or entrainer yoke pairs 30*a* and 30*b* an aligning force or an aligning pulse, which is transmitted by way of the entrainer plates 37*a* and 37*b* and to the cage door transom 24*a*. Due to the fact that the cage door transom 24*a* is movably mounted in the flexible bearings 27*a* and 27*b*, it describes a self-centering aligning movement $M_1$ which is directed oppositely to the skewed setting, corresponding with a skewed setting axis S, towards to a vertical V.

The aligning force or the aligning pulse increases if a spacing A between the entrainer yoke pairs 30*a* and 30*b* or between the entrainer roller pairs 35*a* and 35*b* increases.

Figure 3:
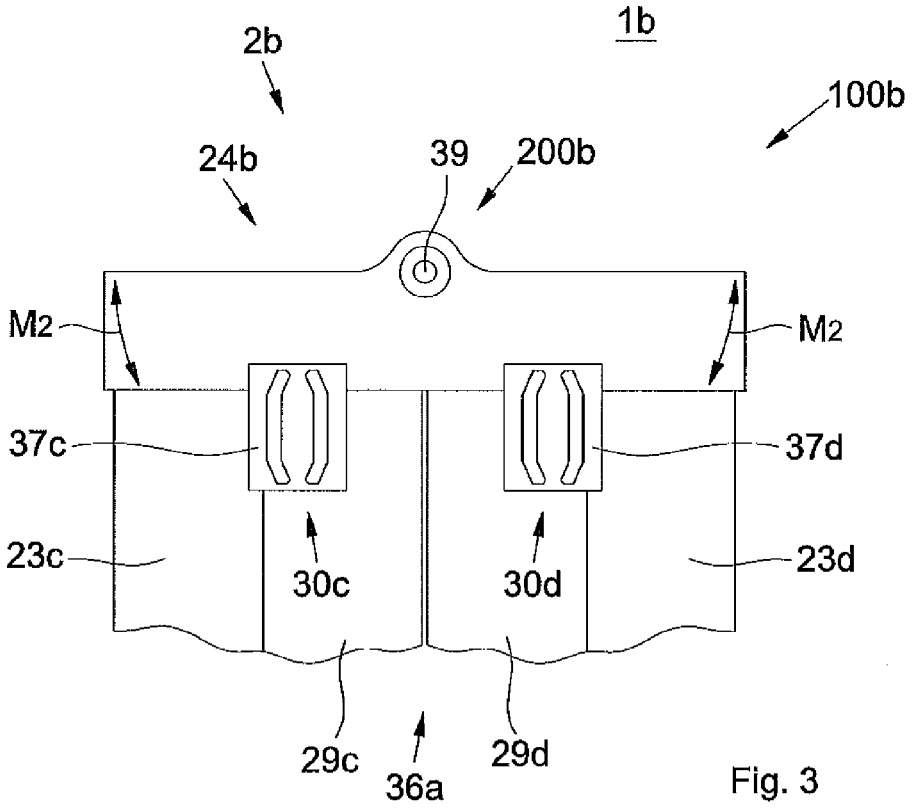
FIG. 3 shows a schematic illustration of a second variant of embodiment of a cage door suspension with a central rotary bearing.

An elevator cage 2*b* is schematically illustrated in part in FIG. 3 in a schematic elevator installation 100*b* or a schematic elevator shaft 1*b*. Arranged at the elevator cage 2*b* is a variant of embodiment of a cage door transom 24*b* by means of a movable mounting 200*b* in the form of a central rotary bearing 39. An aligning force or an aligning pulse, which acts counter to the entrainer yoke pairs 30*c* and 30*d* at respective entrainer plates 37*c* and 37*d*, aligns the cage door transom 24*b* in correspondence with an aligning movement $M_2$. In this regard, a cage door 36*a* consisting of cage door elements 29*c* and 29*d* can be formed to be co-pivoting or also not. Cladding surfaces 23*c* and 23*d*, which are at the front side, of the elevator cage 2*b* do not co-pivot thereagainst, because they are fixedly connected with the latter.

Figure 4:
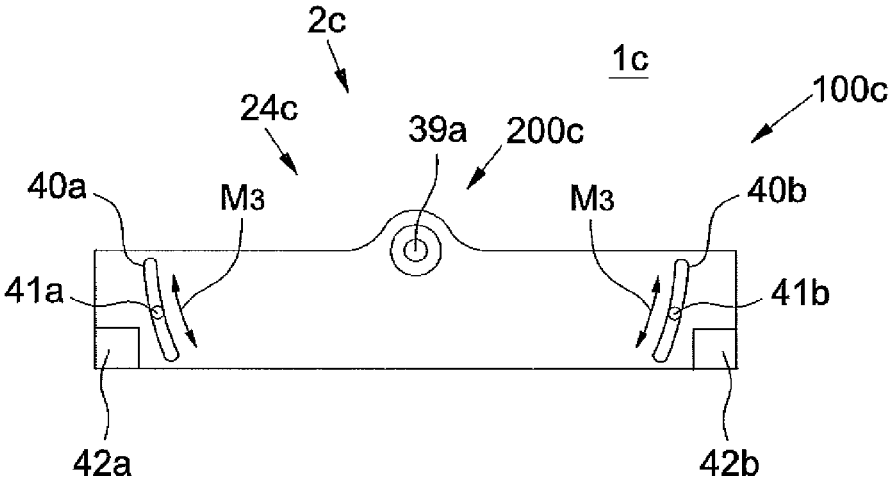
FIG. 4 shows a schematic illustration of a third variant of embodiment of a cage door suspension, which additionally to the first variant of embodiment of FIG. 3 has curved guides.

A further variant of embodiment of a cage door transom 24*c*, which is arranged in a movable mounting 200*c* by means of a central rotary bearing 39*a* at an elevator cage 2*c*, is shown in FIG. 4 in a schematic part illustration. The elevator cage 2*c* is disposed in a schematic elevator installation 100*c* or a schematic elevator shaft 1*c*. The cage door transom 24*c* is distinguished by the fact that it has additionally to the variant of embodiment of FIG. 3 curved guides 40*a* and 40*b* in each of which a respective guide roller or guide pin 41*a* or 41*b* runs along. These guide rollers or pins 41*a* and 41*b* are connected with the frame of the elevator cage 2*c* and thus give more stability to an aligning movement $M_3$ of the cage door transom 24*c* or relieve the central bearing 39*a* of load.

Moreover, FIG. 4 shows that arranged at the distal ends of the cage door transom 24*c* are weights 42*a* and 42*b*, which can by themselves exert the required aligning force or the required aligning pulse for the aligning movement $M_3$ of the cage door transom 24*c* or can act in assisting manner with respect to the aligning force or the aligning pulse by the entrainer rollers at the shaft or the correction rail at the shaft.

Figure 5:
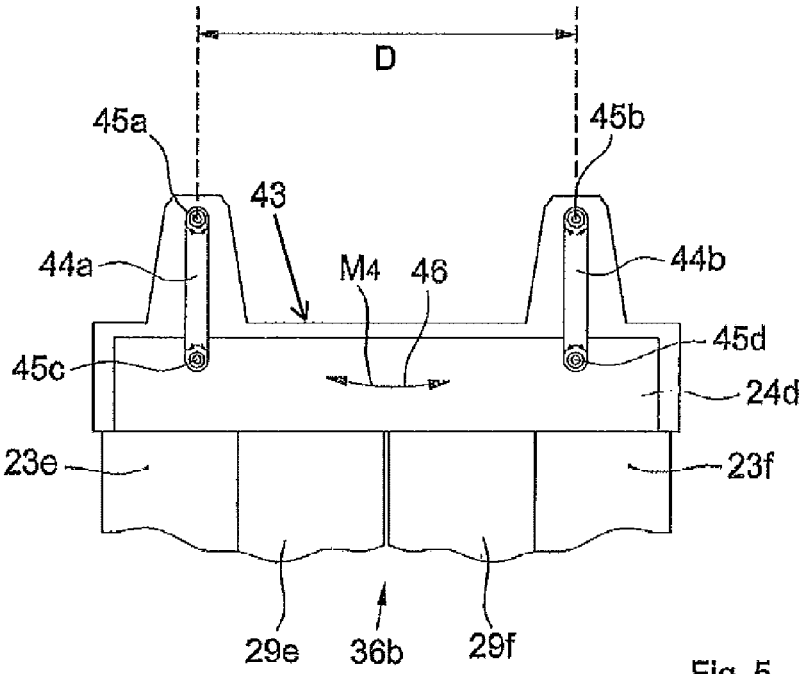
FIG. 5 shows a schematic illustration of a fourth variant of embodiment of a cage door suspension with two rotatably arranged mounting levers.

FIG. 5 shows, in schematic part illustration, two cladding surfaces 23*e* and 23*f* at the front and a cage door 36*b* consisting of two cage door elements 29*e* and 29*f*. The latter overlap the cladding surfaces 23*e* and 23*f* during an opening movement. Moreover, a mounting device 43 is shown for a movable mounting of a cage door transom 24*d* which is suspended in swing-form and which can execute an aligning movement $M_4$ in correspondence with a movement direction 46, because it is held by at least two mounting levers 44*a* and 44*b* which are in turn each rotatably mounted by a respective rotary bearing 45*a* or 45*b*, spaced apart by a distance D, in the mounting device 43 and by a respective rotary bearing 45*c* or 45*d* in the cage door transom 24*d*.

Figure 6:
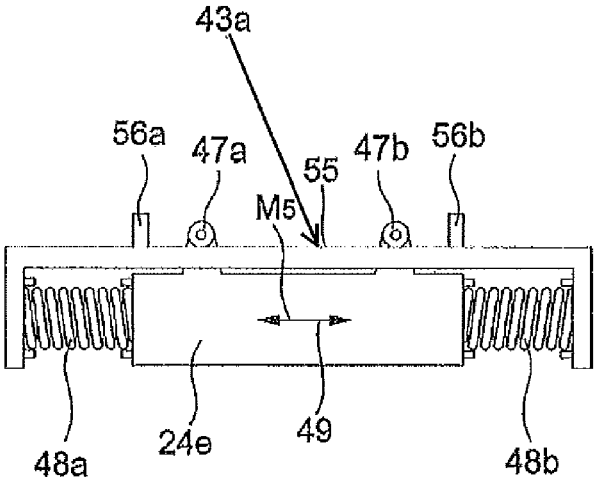
FIG. 6 shows a schematic illustration of a fifth variant of embodiment of a cage door suspension, which is movably arranged in a mounting frame by means of rollers and springs.

FIG. 6 shows in schematic part illustration a mounting device 43*a* for a cage door transom 24*e*. The cage door transom 24*e* is movable in a movement direction 49, because it is suspended by support rollers 47*a* and 47*b* at the mounting device 43*a*. The support rollers 47*a* and 47*b* roll on a guide surface 55 within two abutments 56*a* and 56*b*. In addition, an aligning movement $M_5$ of the cage door transom 24*e* is sprung by springs 48*a* and 48*b*.

An aligning movement $M_5$ in any desired direction can be achieved by support rollers 47*a* and 47*b* in the form of ball rollers and by a guide surface 55 in the form of a planar or also slightly curved plate.

Figure 7:
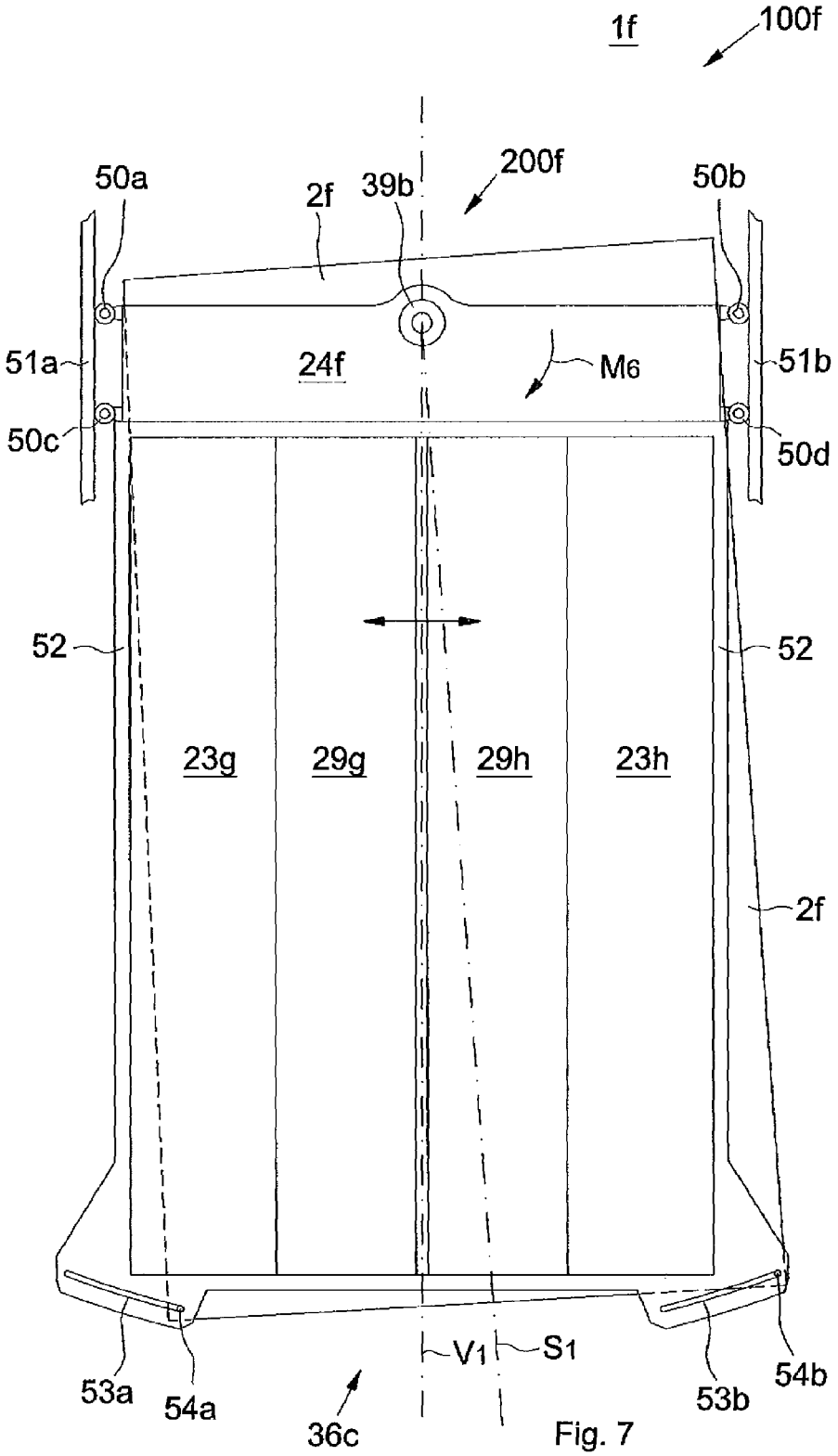
FIG. 7 shows a schematic illustration of a sixth variant of embodiment of a cage door suspension with a door frame which is fixedly arranged at the same and which, thereagainst, is movably attached to the elevator cage.

An elevator cage 2*f*, which is disposed in a skewed setting in correspondence with a skew setting axis $S_1$, is schematically illustrated in FIG. 7 in a schematic elevator installation 100*f* or a schematic elevator shaft 1*f*. A cage door transom 24*f* is pivotably arranged in the upper region of the elevator cage 2*f* by means of a movable mounting 200*f* in the form of a central rotary bearing 39*b*. Aligning rollers 50*a*-50*d*, which run along correction rails 51*a* and 51*b*, are arranged at the sides of the cage door transom 24*f*. The correction rails 51*a* and 51*b* can for this purpose be arranged merely in the region of a shaft door, but also continuously over the entire conveying height of the elevator installation 100*f*. Moreover, several aligning rollers 50*a*-50*d* can be arranged at, for example, only one correction rail 51*a* or 51*b* in two or more horizontal directions so that an aligning movement $M_6$ of the cage door transom 24*f* can take place in several directions, particularly in combination with its fastening by means of flexible bearings (FIG. 2).

The described arrangements of aligning rollers 50*a*-50*d* can replace one or more of the usual guide shoes by which the elevator cage 2*f* is guided to run along the guide rails 7*a* and 7*b* according to FIG. 1.

A door frame 52, in which a cage door 36*c* or cage door elements 29*g* and 29*h* is or are displaceably arranged and in which cladding surfaces 23*g* and 23*h* of the elevator cage 2*f* overlap in the case of opening, is fixedly fastened to the underside of the cage door transom 24*f*. The door frame 52 is in the lower region pivotably arranged at the lower region of the elevator cage 2*f* by means of curved guides 53*a* and 53*b* and guide bolts or guide rollers 54*a* and 54*b* running therein so that the cage door transom 24*f* inclusive of the door frame 52 can remain in a vertical $V_1$ and thus parallel and aligned with respect to shaft door elements of an opposite shaft door. The guide pins or guide rollers 54*a* and 54*b* can be formed free of abutment and longer than required so that the co-description of the aligning movement $M_6$ away from the skew setting axis $S_1$ towards the vertical $V_1$ is then possible within a certain scope, even if the skew setting axis $S_1$ should not happen to lie in the plane of the drawing, i.e. not only lateral skewed settings of the elevator cage 2*f*, but also skewed settings forwardly, rearwardly or diagonally are correctible within the scope of play between guide pins or guide rollers 54*a* and 54*b* in the curved guides 53*a* and 53*b*.

The door frame 52, which thus co-describes the aligning movement $M_6$ of the cage door transom 24*f*, can also be combined with the other disclosed variants of embodiment of a movably mounted cage door transom.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

What is claimed is:

1. An elevator installation including at least one elevator cage, the elevator cage being movable in an elevator shaft along guide rails and having a cage door transom suspending a cage door, the cage door being movable on the cage door transom between a closed position and an open position, comprising:

the cage door transom being movably arranged on the elevator cage by at least one movable mounting, wherein the movable mounting of the cage door transom includes at least two support rollers arranged to roll along a guide surface of a mounting device of the cage door transom;

the cage door transom configured with a means to provide a self-centering aligning movement to an approximately centered setting of the cage door using the at least one movable mounting during operation of the elevator installation; and the self-centering aligning movement occurring in correspondence with an opposed shaft door of the elevator installation in response to an aligning force or aligning pulse exerted on the cage door transom, wherein the cage door transom moves relative to the elevator cage.

2. The elevator installation according to claim 1 wherein the aligning movement of the cage door transom is damped by at least two identical springs or shock dampers arranged in mirror image relative to the transom.

3. The elevator installation according to claim 1 wherein the aligning force or the aligning pulse for the aligning movement of the cage door transom is provided by at least one entrainer roller pair acting, at the shaft door, on at least one entrainer yoke pair at the cage.

4. The elevator installation according to claim 1, wherein the self-centering aligning movement includes movement in a horizontal direction.

5. The elevator installation according to claim 1, wherein the self-centering aligning movement includes movement in two directions.

6. A method of aligning a cage door transom of an elevator cage in an elevator installation, the cage door transom being movably arranged on the elevator cage by at least one movable mounting, the movable mounting of the cage door transom including at least two support rollers arranged to roll along a guide surface of a mounting device of the cage door transom, the cage door transom configured with a means to provide a self-centering aligning movement to an approximately centered setting of the cage door using the at least one movable mounting during operation of the elevator installation, and the cage door transom suspending a cage door, the cage door being movable on the cage door transom between a closed position and an open position, the following method steps being performed when the cage door transom is off-center or out of place relative to an opposed shaft door of the elevator installation:

exerting an aligning force or an aligning pulse on the cage door transom in correspondence with the opposed shaft door, the aligning force or the aligning pulse causing an aligning movement of the cage door transom into an approximately centered setting of the cage door using the at least one moveable mounting, wherein the cage door transom moves relative to the elevator cage; and stopping the exertion of the aligning force or the aligning pulse as soon as the cage door transom is no longer off-center or out of place, so that the cage door transom adopts an uncorrected setting, wherein the cage door transom moves relative to the elevator cage.

7. The method of claim 6, wherein the aligning movement includes movement in a horizontal direction.

8. An elevator installation having an elevator cage being movable in an elevator shaft along guide rails between stories having shaft doors, the elevator cage having a cage door, comprising:

a cage door transom suspending the cage door, the cage door being formed by two cage door elements that abut in a closed position and move in opposite directions on the transom to an open position, the cage door transom being movably arranged on the elevator cage by a mounting device, wherein the mounting device includes at least two support rollers arranged to roll along a guide surface of the mounting device; and at least one entrainer yoke pair arranged at the cage door;

the cage door transom configured with a means to provide a self-centering aligning movement to an approximately centered setting of the cage door using the mounting device during operation of the elevator installation; and the self-centering aligning movement occurring in correspondence with an opposed one of the shaft doors of the elevator installation in response to an aligning force or aligning pulse exerted by at least one entrainer roller pair at the opposed shaft door on the at least one entrainer yoke pair, wherein the cage door transom moves relative to the elevator cage.

9. The elevator installation according to claim 8 wherein the aligning movement of the transom is damped by at least two identical springs or shock dampers arranged in mirror image relative to the transom.

10. The elevator installation according to claim 8, wherein the self-centering aligning movement includes movement in a horizontal direction.

* * * * *